United States Patent [19]

Monroe

[11] Patent Number: 4,989,848

[45] Date of Patent: Feb. 5, 1991

[54] APPARATUS FOR ADJUSTING THE POSITION OF THE UPPER BODY SUPPORT OF AN ORTHOPEDIC TABLE

[75] Inventor: Lawrence S. Monroe, Erie, Pa.

[73] Assignee: American Sterilizer Company

[21] Appl. No.: 332,655

[22] Filed: Dec. 21, 1981

[51] Int. Cl.[5] ..... A61G 13/00

[52] U.S. Cl. ..... 269/322

[58] Field of Search ..... 269/322–328, 269/164; 128/70–73, 83–84; 5/81 B; 108/137, 143, 102

[56] References Cited

U.S. PATENT DOCUMENTS

| | | | |
|---|---|---|---|
| 2,198,871 | 4/1940 | Haboush | 128/84 R |
| 2,495,438 | 1/1950 | Bentley et al. | 269/70 |
| 2,926,977 | 3/1960 | Ragon | 269/328 |
| 3,509,876 | 5/1970 | Pilz | 269/328 |
| 3,541,617 | 11/1970 | Clanan | 5/81 B |
| 3,654,920 | 4/1972 | Staib | 128/71 |
| 3,745,996 | 7/1973 | Rush | 269/328 |
| 3,845,946 | 11/1974 | Warden et al. | 269/323 |
| 4,039,799 | 8/1977 | Stumpf | 269/296 |
| 4,243,025 | 1/1981 | Jones | 269/328 |
| 4,259,756 | 4/1981 | Pace | 5/81 B |

*Primary Examiner*—Robert C. Watson

[57] ABSTRACT

Apparatus for controlling movement of the upper body support of an orthopedic table in a direction parallel with the plane of the upper body support includes apparatus mounted to the base of the table for slidably securing the upper body support to the base, apparatus for locking the upper body support in at least one position relative to the base of the table and apparatus for operating the locking apparatus. The apparatus permits the patient to be positioned or repositioned relative to the base of the table and affords a surgeon good access to all parts of the patient's body and permits complete examination of the patient using image-amplification equipment.

1 Claim, 6 Drawing Sheets

APPARATUS FOR ADJUSTING THE POSITION OF THE UPPER BODY SUPPORT OF AN ORTHOPEDIC TABLE

BACKGROUND OF THE INVENTION

1. Field of the Invention

The present invention relates to orthopedic tables and, more particularly, to apparatus for positioning the upper body support of an orthopedic table.

2. Description of the Prior Art

Performance of modern orthopedic surgical procedures requires a support, or table, for the patient on whom the procedures are to be performed that satisfies several needs. The table must permit hospital personnel to transfer a patient from a litter to the table in a manner that requires application to the patient's body of as little physical stress as possible. The table should facilitate quick, convenient and precise positioning of the patient's body on the table. The table must permit hospital personnel to reposition the patient's body relative to the table with application to the patient's body of as little physical stress as possible. The table must provide unrestricted access by the orthopedic surgeon to the parts of the patient's body on which the surgical procedures are being performed. The table must permit positioning of image-amplification apparatus proximate all parts of the patient's body to permit examination of the parts of the patient's body on which the surgeon will perform surgical procedures, regardless of the type of procedure to be performed.

Conventional orthopedic tables include a support for the upper body of the patient, a base for supporting the upper body support a distance from the floor and abductor bars extending from the base for supporting and positioning the patient's legs. The abductor bars are usually mounted to the base for pivotal movement and include foot supports which are clamped to the bars. The foot supports can be moved along the abductor bars to accommodate patients of different sizes. The upper body support of a conventional orthopedic table is fixed to the base and cannot be moved relative to it. Further, the base of a conventional orthopedic table commonly includes a housing beneath the upper body support which contains control apparatus for tilting the upper body support, or portions of it, to facilitate performance of certain orthopedic surgical procedures.

The fixed position of the upper body support relative to the control housing and the portion of the table base which contacts the floor and the proximity of the housing to the upper body support cause several problems. Because image-amplification equipment must be placed near—usually both above and below—the part of the body to be examined, and because the control housing and base of conventional tables prevent such equipment from being positioned in a number of areas beneath the upper body support, the area of the patient's body which can be examined with image-amplification apparatus is limited. Further, the control housing and base often prevent the orthopedic surgeon from assuming the position relative to the patient's body that is most favorable for performing a particular surgical procedure. Often, the control housing and base prevent personnel from positioning a litter bearing a patient adjacent the upper body support, thus forcing hospital personnel to manually transport the patient through a distance and risk causing the patient's body to experience physical trauma. Moreover, the fixed position, relative to the upper body support, of the ends of the abductor bars that are secured to the base ensures that the upper body support or abductor bars, depending on which surgical procedure is being performed, will hamper the orthopedic surgeon during performance of the procedure. Also, since the position of the abductor bars relative to the upper body support cannot be altered, repositioning of the patient relative to the abductor bars for bilateral procedures must be accomplished by physically moving the patient on the upper body support, thereby creating the possibility that the patient's body will experience physical trauma.

Accordingly, there exists a need for an orthopedic table that provides better access to areas of a patient's body upon which orthopedic surgical procedures are being performed than is provided by conventional orthopedic tables. Further, there exists a need for an orthopedic table that minimizes the risk of causing a patient's body to experience physical trauma when the patient is transferred from a litter to the table and as the surgical procedures are being performed.

SUMMARY OF THE INVENTION

The present invention is particularly useful with an orthopedic table, for supporting and positioning a patient. The table of the type having a support for the upper body of the patient, a base adapted to position the upper body support a distance from the floor, members secured to the base adapted to support the legs of the patient and a support for the sacrum of the patient supported by the base. The upper body support is movable transversely of the longitudinal axis defined by the table. An example of a table of the type described immediately above is disclosed in applications for United States Letters Patent Serial Nos. 587,926 and 332,656. The present invention provides improved apparatus for mounting the upper body support to the base to permit transverse movement of the upper body support with respect to the table. The apparatus includes a device mounted to the base for slidably securing the upper body support to the base to permit the upper body support to be slid relative to the base in a direction that is parallel to the plane of the upper body support, apparatus for selectively preventing the upper body support from sliding relative to the base, and apparatus for operating the preventing apparatus.

BRIEF DESCRIPTION OF THE DRAWINGS

The following detailed description of the preferred embodiments can be understood better if reference is made to the attached drawings in which.

DETAILED DESCRIPTION OF THE PREFERRED EMBODIMENTS

Figure 1:
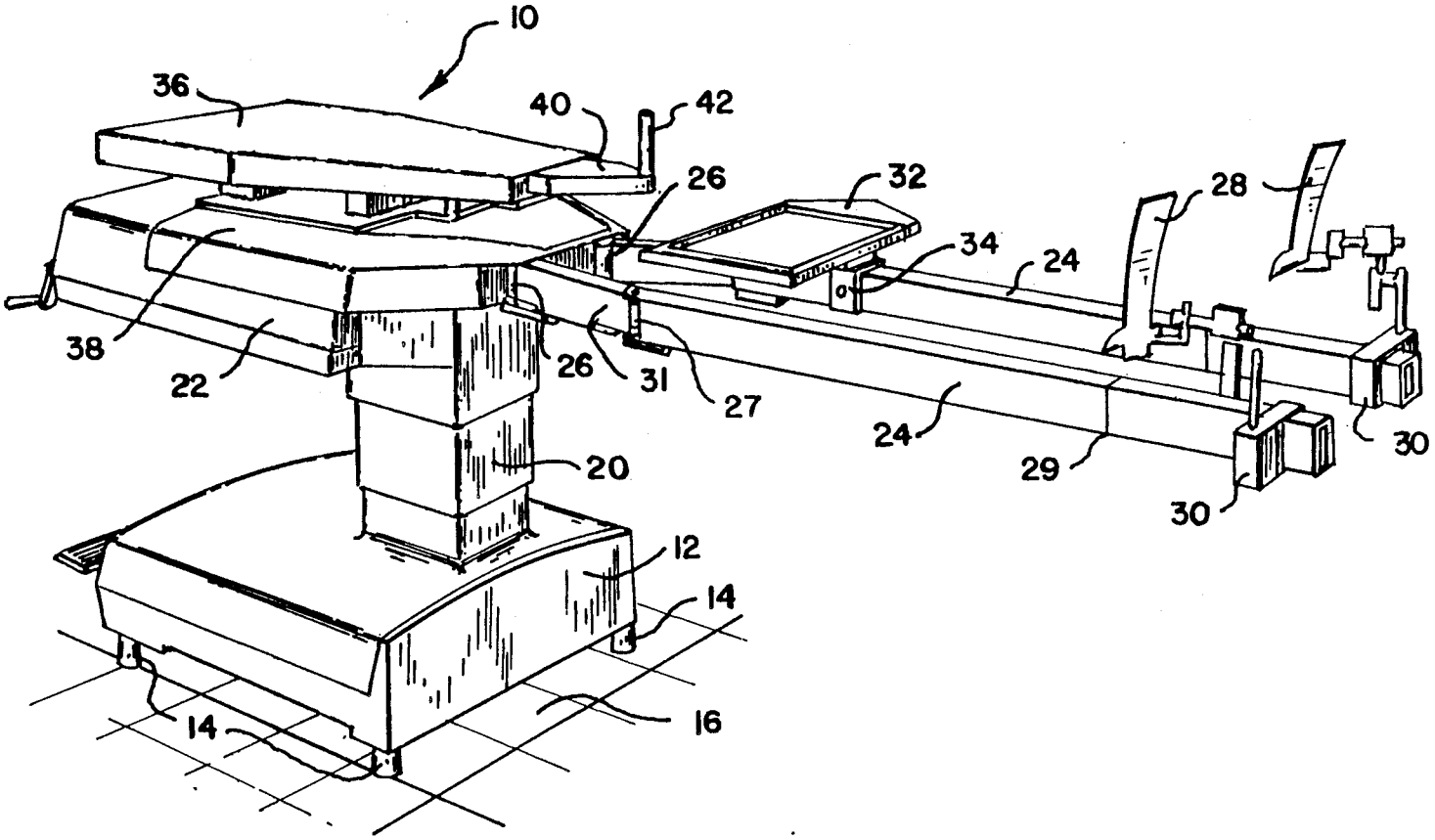
FIG. 1 is an isometric view of an orthopedic surgical table having apparatus for moving the upper body support of the table that is constructed according to the provisions of the present invention.
Figure 2:
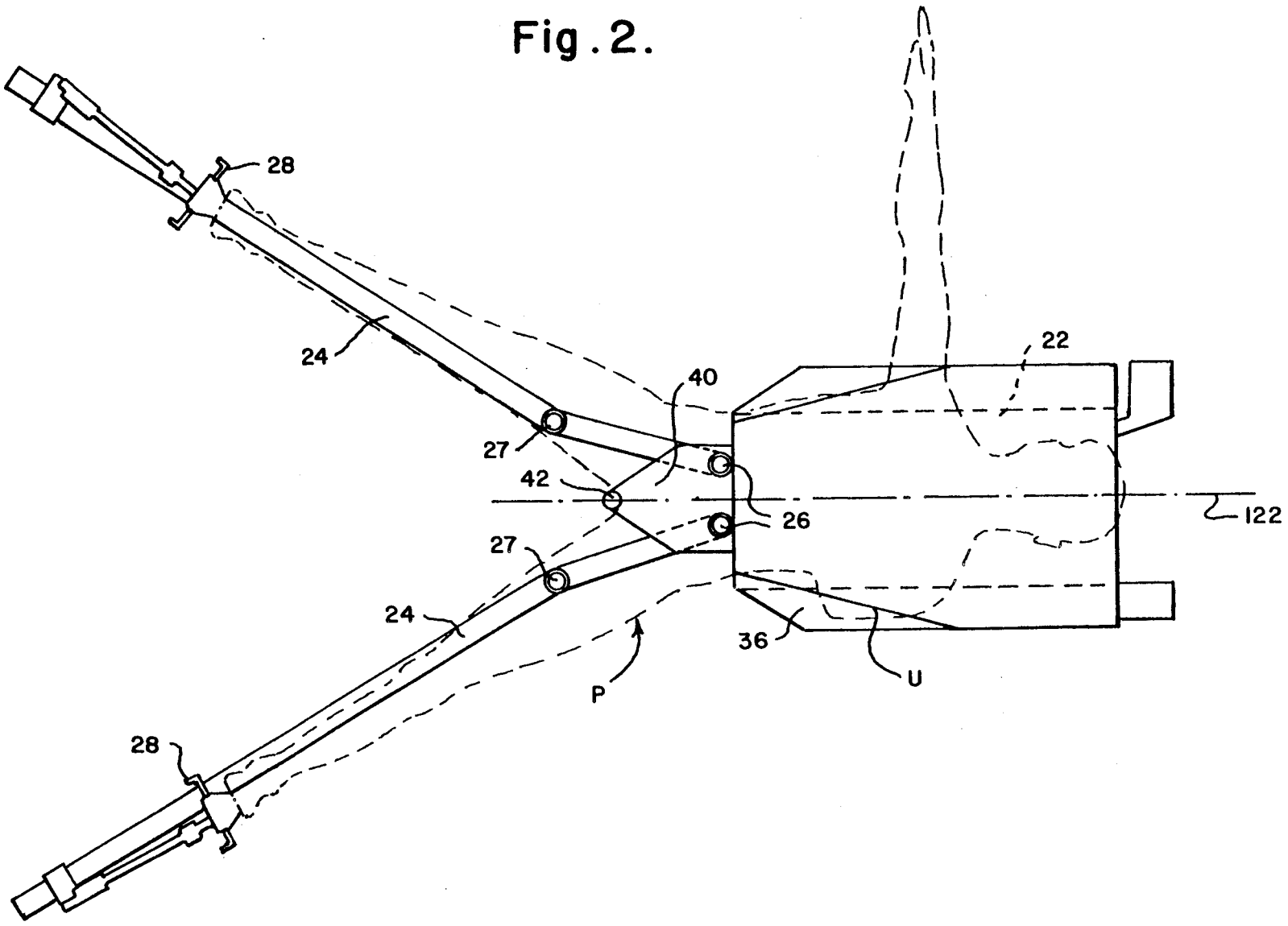
FIG. 2 is a graphic view showing a portion of the table shown in FIG. 1, a patient disposed on the table, and the upper body support in its central position.
Figure 3:
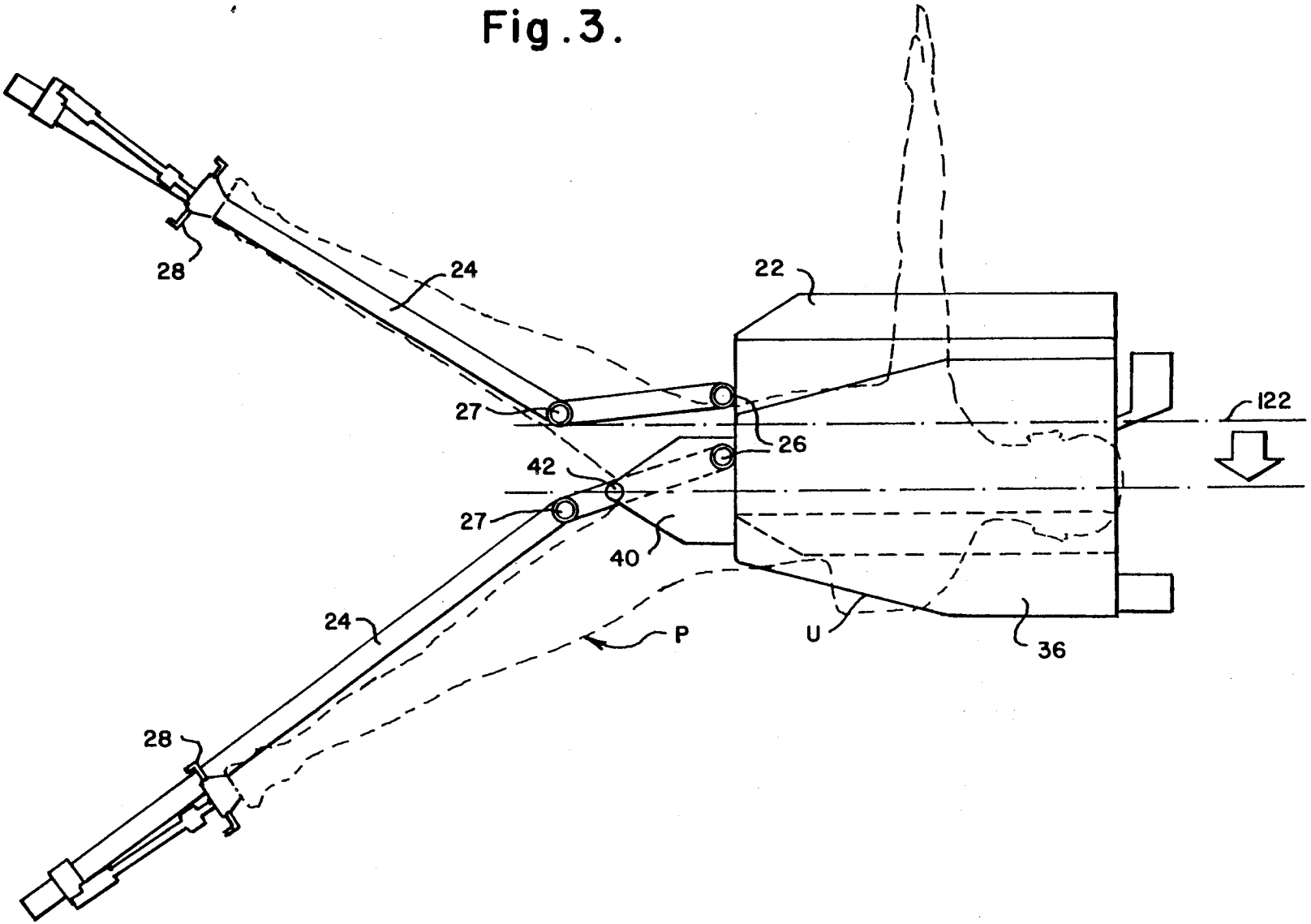
FIG. 3 is a graphic view similar to FIG. 2 but showing the upper body support 36 in one of its off-center positions.
Figure 4:
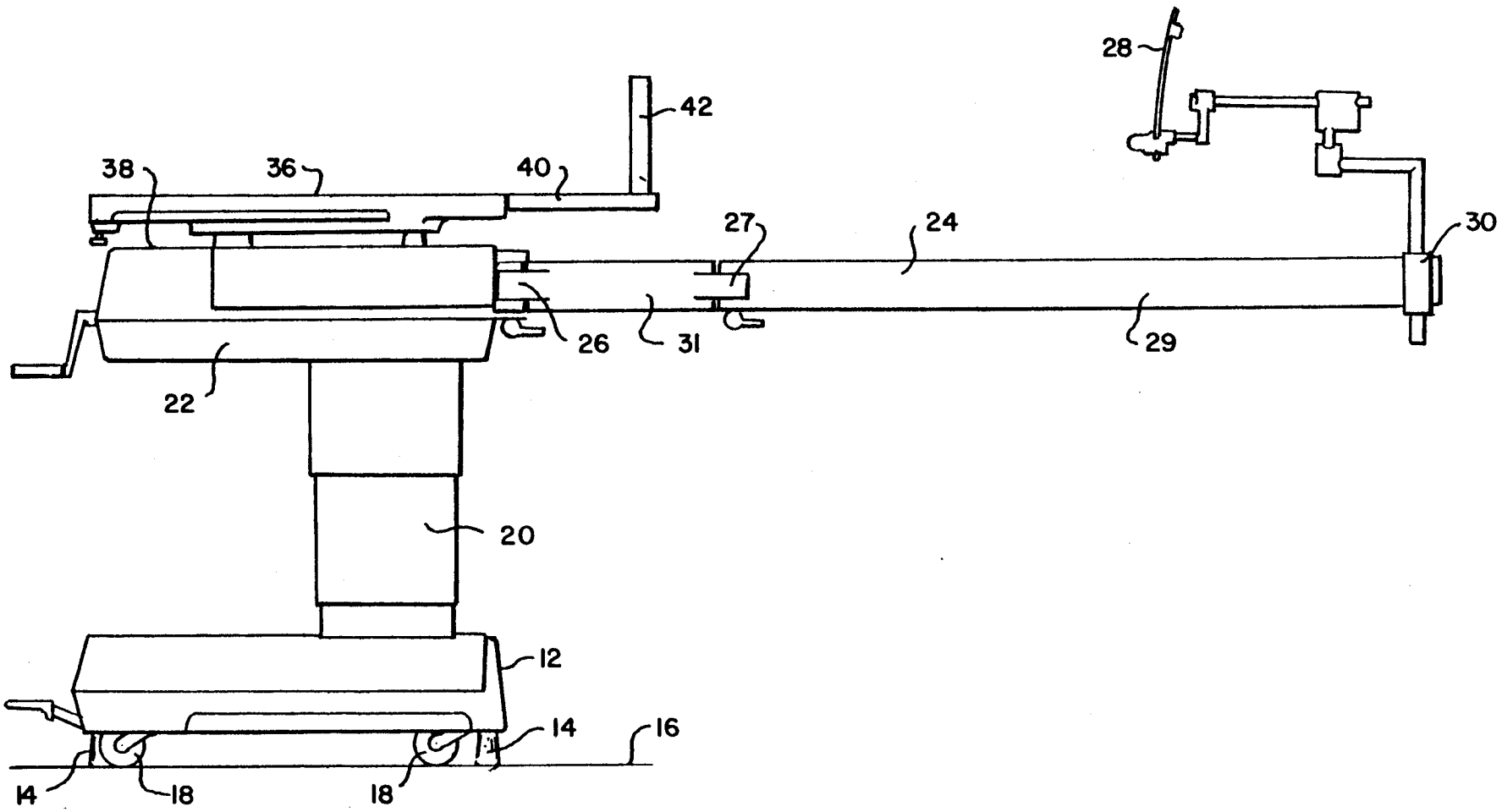
FIG. 4 is a side elevational view of the orthopedic table shown in FIG. 1, but with the X ray plate removed.

FIGS. 1 through 7 show an orthopedic table including the preferred embodiment of the present invention. Orthopedic table 10 is of the type disclosed in application for United States Letters Patent Serial Nos. 587,926 and 332,656. FIGS. 1 and 4 show orthopedic table 10 which has a conventional base and leg support members. Table 10 includes base member 12 which is supported by four legs 14, one leg 14 disposed at each corner of base member 12, a distance from floor 16. Legs 14 may be of the retractable type which can be withdrawn into base member 12 to permit wheels 18 to contact floor 16 and enable hospital personnel to conveniently reposition table 10 within a room. Column 20 is secured to base member 12 and a control housing 22 in any suitable manner to support control housing 22 a distance from base member 12. Control housing 22, column 20 and base member 12 can include any known control mechanism and operators for tilting control housing 22 to facilitate performance of a variety of orthopedic surgical procedures.

A pair of abductor bars 24 is pivotally secured at 26 to control housing 22 in any suitable known fashion. Abductor bars 24 are capable of horizontal pivotal movement relative to control housing 22 at points 26. Abductor bars 24 include joints 27 to permit members 29 to be pivoted relative to members 31. Abductor bars 24 include foot supports 28 which are releasably and slidably secured to abductor bars 24 with any suitable clamps 30. Foot supports 28 are of any suitable conventional type. Each abductor bar 24 can be adapted to receive a conventional X ray plate, such as X ray plate 32 shown in FIG. 1, which is clamped to an abductor bar 24 with a suitable clamp 34 which permits sliding movement of X ray plate 32 along abductor bar 24.

Upper body support 36 is mounted using the present invention to upper surface 38 of control housing 22 for horizontal movement as described more fully below. Sacrum rest 40, including vertical post 42, is rigidly secured to upper body support 36 for movement therewith. Sacrum rest 40 can be secured to upper body support 36 or can be formed integrally therewith as upper body support 36 is fabricated.

Upper body support 36 and sacrum rest 40 are movable together in a direction perpendicular to the longitudinal axis of control housing 22 as shown in FIGS. 2 and 3. Accordingly, the upper body U of patient P can be repositioned without moving patient P relative to upper body support 36 and upper body U of patient P can be moved away from points of attachment 26 of abductor bars 24 to control housing 22 and away from control housing 22, column 20 and base member 12, thereby providing the benefits described above.

Figure 5:
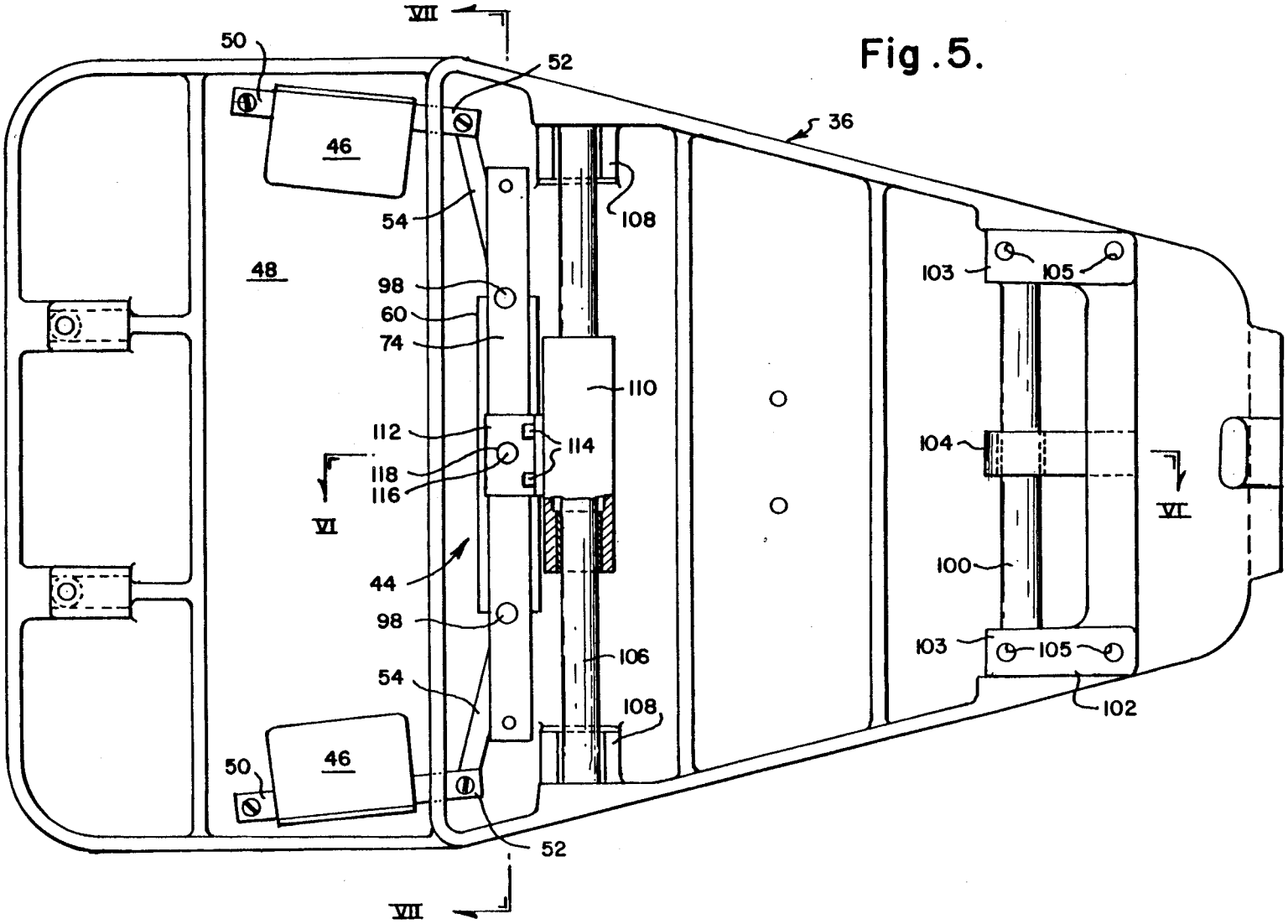
FIG. 5 is a bottom view of the upper body support showing the apparatus for moving the upper body support of the table that is taught by the present invention.
Figure 6:
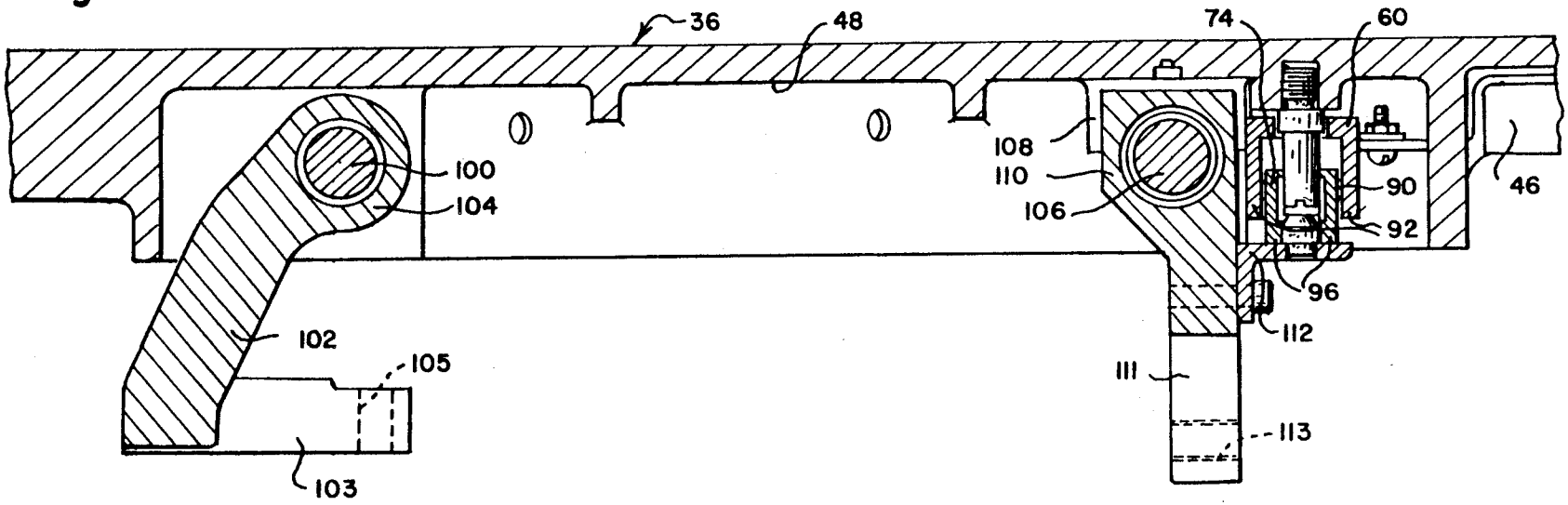
FIG. 6 is a side sectional view of the upper body support shown in FIG. 5, taken along the line VI—VI.
Figure 7:
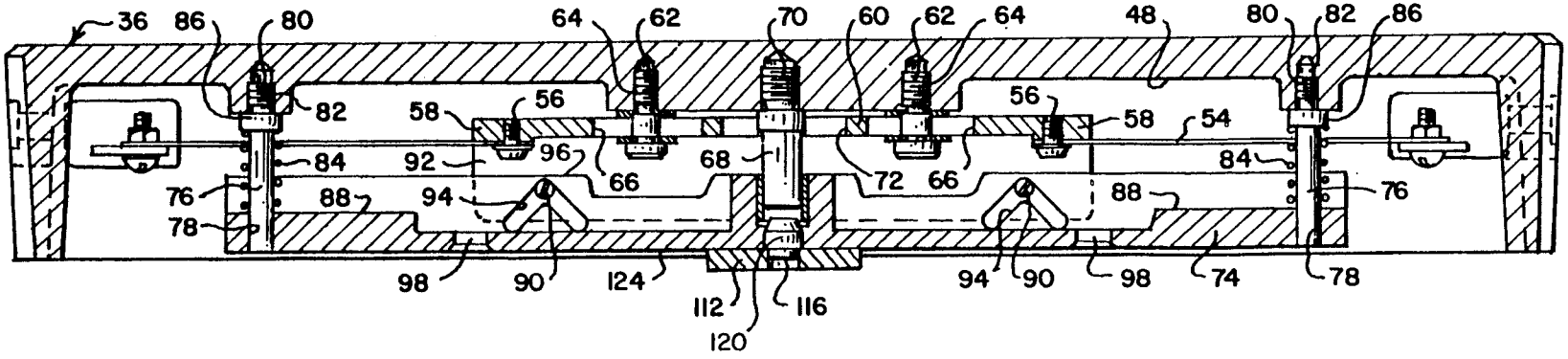
FIG. 7 is a sectional view of the upper body support shown in FIG. 5, taken along the line VII—VII.

FIGS. 5 through 7 depict the mechanism 44—the preferred embodiment of the present invention—which is used to mount upper body support 36 to control housing 22 and to control the movement of upper body support 36 in a direction parallel to the plane of upper body support 36. Mechanism 44 includes operators 46, one end 50 of each of which is secured to lower surface 48 of upper body support 36. Each remaining end 52 of operators 46 is pivotally secured to an end of a member 54. One end 56 of each member 54 is secured to an end 58 of slide bar 60. Two screws 62 are threaded into threaded openings 64 of upper body support 36 through slide slots 66 formed in slide bar 60. A post 68 is threaded into opening 70 of support 36 through slide slot 72 of slide bar 60.

A lock bar 74 is secured to upper body support 36 for limited movement toward and away from lower surface 48 of upper body support 36. Threaded posts 76 are secured at one end within opening 78 of lock bar 74 and include threaded ends 80 which are threaded into openings 82 of upper body support 36. A spring 84 is disposed around each post 76 between collar 86 of post 76 and surface 88 of lock bar 74. Slide pins 90 are secured to flanged end 92 of slide bar 60. Each slide pin 90 passes through a cam slot 94 formed in flanged end 96 of lock bar 74. Openings 98 are also formed in lock bar 74.

Further, a slide bar 100 is secured at its ends to a bracket 102, which is secured to control housing 22 by bolting flanges 103 of bracket 102 to control housing 22 through openings 105. Bracket 102 includes a bearing 104 through which slide bar 100 slides. Also secured to upper body support 36 is a slide bar 106 which is fixed at its ends to mountings 108 in any suitable fashion. A bearing 110 is secured to control housing 22 by bolting ends 111 (only one shown) of bearing 110 to control housing 22 through openings 113 (only one shown); bearing 110 receives travel bar 106 and permits it to slide therethrough. The stop pin flange 112 is secured to bearing 110 with bolts 114. A stop pin 116 is secured within opening 118 of flange 112 and is adapted to be inserted within openings 98 and 120 of lock bar 74.

When movement of upper body support 36 is not prevented by lock bar 74 and stop pin 116, upper body support 36 can be moved in a direction that is perpendicular to center line 122 of table 10 by exerting a force in the horizontal direction on upper body support 36. Such application of force causes travel bars 106 and 100 to slide through bearings 110 and 104, respectively, and upper body support 36 is moved relative to table 10. Upper body support 36 can be locked in one of three positions, a central position in which the longitudinal axis of upper body support 36 is substantially colinear with center line 122 of table 10 and two off-center positions in which upper body support 36 is disposed more to one side or the other of center line 122. Upper body support 36 is locked in its central position when stop pin 116 is disposed within opening 120 of lock bar 74. Upper body support 36 is locked in its off-center positions when stop pin 116 is disposed within either opening 98. Springs 84 are compression springs and bias lock bar 74 toward a position in which its lower surface 124 contacts stop pin 116 or in which stop pin 116 is disposed within one of openings 98 or opening 120, depending on the position of lock bar 74 relative to pin 116.

If lock bar 74 is disposed in such a position that pin 116 is disposed in an opening 98 or opening 120, the relative position of upper body support 36 can be changed only if either operator 46 is pulled toward the perimeter of upper body support 36. When an operator 46 is so moved, member 54 pulls slide member 60 in the direction of movement of operator 46 causing pins 90 to exert force on cam slots 94 and lift lock bar 74 toward lower surface 48 of upper body support 36 to remove pin 116 from within an opening 98 or opening 120. Upper body support 36 is then moved horizontally to the desired position. To once again lock upper body support 36, upper body support 36 must be moved horizontally until stop pin 116 becomes aligned with an opening 98 or opening 120, thereby permitting springs 84 to force lock bar 74 away from lower surface 48 of upper body support 36 and dispose stop pin 116 within an opening 98 or opening 120. At that point, further movement of upper body support 36 is not possible until an operator 46 is moved toward the perimeter of upper body support 36.

What is claimed is:

1. Apparatus for mounting the upper body support to the base of an orthopedic table which supports and positions a patient, the table defining a longitudinal axis and being of the type having a support for the upper body of the patient, a base adapted to position the upper body support a distance from the floor, members secured to the base adapted to support the legs of the patient and a support for the sacrum of the patient supported by the base, said mounting apparatus permitting movement of the upper body support transversely of said longitudinal axis and comprising:

a slide bar mounted to the upper body support;

a bearing secured to the base adapted to receive said slide bar and through which said slide bar can slide transversely of said longitudinal axis of the table;

a lock bar mounted to the upper body support and adapted to releasably engage a lock pin, said lock pin preventing said lock bar and the upper body support from sliding when said lock pin and said lock bar are engaged with each other; and means for causing said lock bar to become engaged with or disengaged from said lock pin;

said lock bar defining an opening adapted to receive said lock pin and means for biasing said lock bar toward said lock pin, and further defining a cam opening;

said causing means including an operator bar to which a cam pin is secured, said cam pin extending through and slidable within said cam opening, movement of said cam pin within said cam opening causing a change of position of said opening relative to said lock pin, and an operator for moving said operator bar relative to the upper body support and moving said cam pin within said cam opening between a position in which said lock pin can be disposed within said opening and a position in which said lock pin cannot be disposed within said opening.

* * * * *

UNITED STATES PATENT AND TRADEMARK OFFICE

CERTIFICATE OF CORRECTION

PATENT NO. : 4,989,848

DATED : February 5, 1991

INVENTOR(S) : Lawrence S. Monroe

It is certified that error appears in the above-identified patent and that said Letters Patent is hereby corrected as shown below:

Col. 2, line 25, delete "an" and substitute therefor --a--.

Col. 2, lines 26 and 27, delete "orthopedic table, for supporting and positioning a patient . The"

Signed and Sealed this

Eighteenth Day of August, 1992

*Attest:*

DOUGLAS B. COMER

*Attesting Officer*

*Acting Commissioner of Patents and Trademarks*